US008736461B2

(12) United States Patent
Sharma et al.

(10) Patent No.: US 8,736,461 B2
(45) Date of Patent: May 27, 2014

(54) CONTROL METHOD OF TRAFFIC SIGN BY UTILIZING VEHICULAR NETWORK

(75) Inventors: Pranay Sharma, Hsinchu (TW); Lien-Wu Chen, Taoyuan County (TW); Yu-Chee Tseng, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 17 days.

(21) Appl. No.: 13/532,322

(22) Filed: Jun. 25, 2012

(65) Prior Publication Data

US 2013/0342370 A1 Dec. 26, 2013

(51) Int. Cl.
*G06G 1/08* (2006.01)

(52) U.S. Cl.
USPC ..... 340/906; 340/907; 340/909

(58) Field of Classification Search
CPC ..... G08G 1/00; G08G 1/01; G08G 1/08; G08G 1/81; G08G 1/095
USPC ..... 340/902, 906, 907, 909, 916, 917, 933, 340/935; 701/300, 302
See application file for complete search history.

(56) References Cited

U.S. PATENT DOCUMENTS

| | | | | |
|---|---|---|---|---|
| 5,926,113 | A * | 7/1999 | Jones et al. | 340/906 |
| 5,986,575 | A * | 11/1999 | Jones et al. | 340/906 |
| 6,243,026 | B1 * | 6/2001 | Jones et al. | 340/906 |
| 7,327,280 | B2 * | 2/2008 | Bachelder et al. | 340/906 |
| 7,557,731 | B2 | 7/2009 | Ramasubbu | |
| 7,864,071 | B2 * | 1/2011 | Bachelder et al. | 340/906 |
| 2008/0094250 | A1 * | 4/2008 | Myr | 340/909 |
| 2008/0243366 | A1 | 10/2008 | Kwong et al. | |
| 2009/0231160 | A1 | 9/2009 | Ramasubbu | |
| 2010/0017103 | A1 | 1/2010 | Kwong et al. | |
| 2010/0017104 | A1 | 1/2010 | Kwong et al. | |

OTHER PUBLICATIONS

Haddad, et al., "Optimal Steady-State Control for Isolated Traffic Intersections", IEEE Transactions on Automatic Control, vol. 55, No. 11, Nov. 2010, pp. 2612-2617.

Al-Khateeb, et al., "Dynamic Traffic Light Sequence Algorithm Using RFID", Journal of Computer Science 4(7), 2008, pp. 517-524.

Milanes, et al., "Controller for Urban Intersections Based on Wireless Communications and Fuzzy Logic", IEEE Transactions on Intelligent Transportion Systems, vol. 11, No. 1, Mar. 2010, pp. 243-248.

Wunderlich, et al., "A Novel Signal-Scheduling Algorithm With Quality-of-Service Provisioning for an Isolated Intersection", IEEE Transactions on Intelligent Transportation Systems, vol. 9, No. 3, Sep. 2008, pp. 536-547.

Sanketh Kumar P., et al., "I2V and V2V Communication based VANET to Optimize Fuel Consumption at Traffic Signals", 2010 13th International IEEE, Annual Conference on Intelligent Transportation Systems, Madeira Island, Portugal, Sep. 19-22, 2010, pp. 1251-1255.

* cited by examiner

*Primary Examiner* — Van T. Trieu
(74) *Attorney, Agent, or Firm* — Muncy, Geissler, Olds & Lowe, P.C.

(57) ABSTRACT

The present invention provides a control method of traffic sign by utilizing vehicular network which can be applied to an intersection. The method comprises: a passing rate calculating step, calculating a passing rate according to a driving parameter; a vehicular movement type determining step, determining a vehicular movement type of a lane at the intersection according to the driving parameter; and a signal determining step, determining next signal according to the passing rate and the vehicular movement type.

7 Claims, 11 Drawing Sheets

$$S^0 = \begin{vmatrix} 1 & 0 & 0 & 0 \\ 1 & 0 & 0 & 0 \\ 0 & 0 & 1 & 0 \\ 0 & 0 & 1 & 0 \end{vmatrix} \quad S^1 = \begin{vmatrix} 0 & 0 & 1 & 0 \\ 0 & 0 & 1 & 0 \\ 1 & 0 & 0 & 0 \\ 1 & 0 & 0 & 0 \end{vmatrix} \quad S^{14} = \begin{vmatrix} 1 & 0 & 0 & 0 \\ 1 & 0 & 0 & 0 \\ 1 & 0 & 1 & 0 \\ 0 & 0 & 0 & 0 \end{vmatrix}$$

$$S^2 = \begin{vmatrix} 0 & 1 & 0 & 0 \\ 0 & 1 & 0 & 0 \\ 0 & 0 & 0 & 0 \\ 0 & 0 & 0 & 0 \end{vmatrix} \quad S^3 = \begin{vmatrix} 0 & 0 & 0 & 0 \\ 0 & 0 & 0 & 0 \\ 0 & 1 & 0 & 0 \\ 0 & 1 & 0 & 0 \end{vmatrix} \quad S^{15} = \begin{vmatrix} 1 & 0 & 0 & 0 \\ 1 & 0 & 0 & 0 \\ 0 & 0 & 0 & 0 \\ 1 & 0 & 1 & 0 \end{vmatrix}$$

$$S^4 = \begin{vmatrix} 0 & 0 & 0 & 1 \\ 0 & 0 & 0 & 0 \\ 1 & 0 & 0 & 0 \\ 0 & 0 & 0 & 0 \end{vmatrix} \quad S^5 = \begin{vmatrix} 0 & 0 & 0 & 0 \\ 0 & 0 & 0 & 1 \\ 0 & 0 & 0 & 0 \\ 1 & 0 & 0 & 0 \end{vmatrix}$$

$$S^6 = \begin{vmatrix} 0 & 0 & 0 & 0 \\ 1 & 0 & 0 & 0 \\ 0 & 0 & 0 & 1 \\ 0 & 0 & 0 & 0 \end{vmatrix} \quad S^7 = \begin{vmatrix} 1 & 0 & 0 & 0 \\ 0 & 0 & 0 & 0 \\ 0 & 0 & 0 & 0 \\ 0 & 0 & 0 & 1 \end{vmatrix}$$

$$S^8 = \begin{vmatrix} 1 & 0 & 0 & 0 \\ 0 & 1 & 0 & 0 \\ 0 & 0 & 0 & 0 \\ 1 & 0 & 0 & 0 \end{vmatrix} \quad S^9 = \begin{vmatrix} 0 & 1 & 0 & 0 \\ 1 & 0 & 0 & 0 \\ 1 & 0 & 0 & 0 \\ 0 & 0 & 0 & 0 \end{vmatrix}$$

$$S^{10} = \begin{vmatrix} 0 & 0 & 0 & 0 \\ 1 & 0 & 0 & 0 \\ 0 & 1 & 0 & 0 \\ 1 & 0 & 0 & 0 \end{vmatrix} \quad S^{11} = \begin{vmatrix} 1 & 0 & 0 & 0 \\ 0 & 0 & 0 & 0 \\ 1 & 0 & 0 & 0 \\ 0 & 1 & 0 & 0 \end{vmatrix}$$

$$S^{12} = \begin{vmatrix} 1 & 0 & 1 & 0 \\ 0 & 0 & 0 & 0 \\ 1 & 0 & 0 & 0 \\ 1 & 0 & 0 & 0 \end{vmatrix} \quad S^{13} = \begin{vmatrix} 0 & 0 & 0 & 0 \\ 1 & 0 & 1 & 0 \\ 1 & 0 & 0 & 0 \\ 1 & 0 & 0 & 0 \end{vmatrix}$$

FIG. 3C

CONTROL METHOD OF TRAFFIC SIGN BY UTILIZING VEHICULAR NETWORK

BACKGROUND OF THE INVENTION (a) Field of the Invention

The invention relates to a control method of a traffic sign, particularly to a control method of a traffic sign by utilizing a vehicular network.

(b) Description of the Related Art

In general, a method of controlling a traffic sign usually controls every constant period of time and thus it cannot adjust dynamically according to the present traffic flow. On the other hand, an adjustable sign utilizes a detector to detect a live traffic flow. For example, an induction coil, magnetic sensor or roadside video recognition technology can be used.

Currently, a system utilizing a wireless sensor network (WSN) needs sensors and a RFID (Radio-frequency identification)-based system needs RFID readers installed in every section. Thus, hardware build-up cost is high. Besides, many problems still exist. First, the traffic flows with longer queues may have lower passing rates than those with shorter queues. Second, the existing approach may cause starvation to shorter queues. Thirdly, some lanes may have mixture of straight-going and right/left-turning vehicles. Furthermore, since each section usually includes a shared right turn lane, vehicles going straight may be blocked by vehicles turning right or vice versa. Especially, such a traffic flow mixing vehicles going straight and turning right causes the decrease in traffic volume.

BRIEF SUMMARY OF THE INVENTION

One object of the invention is to adjust time length and order of a traffic sign.

One object of the invention is to increase the vehicular passing rate at an intersection.

One object of the invention is to decrease greenhouse gases generated when vehicles are idling at an intersection.

One embodiment of the invention provides a control method of a traffic sign by utilizing a vehicular network which is applicable to an intersection. The method comprises: a passing rate calculating step, calculating a passing rate according to a driving parameter; a vehicular movement type determining step, determining a vehicular movement type of a lane at the intersection according to the driving parameter; and a signal determining step, determining next signal according to the passing rate and the vehicular movement type.

Other objects and advantages of the invention can be better understood from the technical characteristics disclosed by the invention. In order to clarify the above mentioned and other objects and advantages of the invention, examples accompanying with figures are provided and described in details in the following.

BRIEF DESCRIPTION OF THE DRAWINGS

FIG. 3C shows a schematic diagram illustrating a signal phase matrix according to one embodiment of the invention.

DETAILED DESCRIPTION OF THE INVENTION

Figure 1:
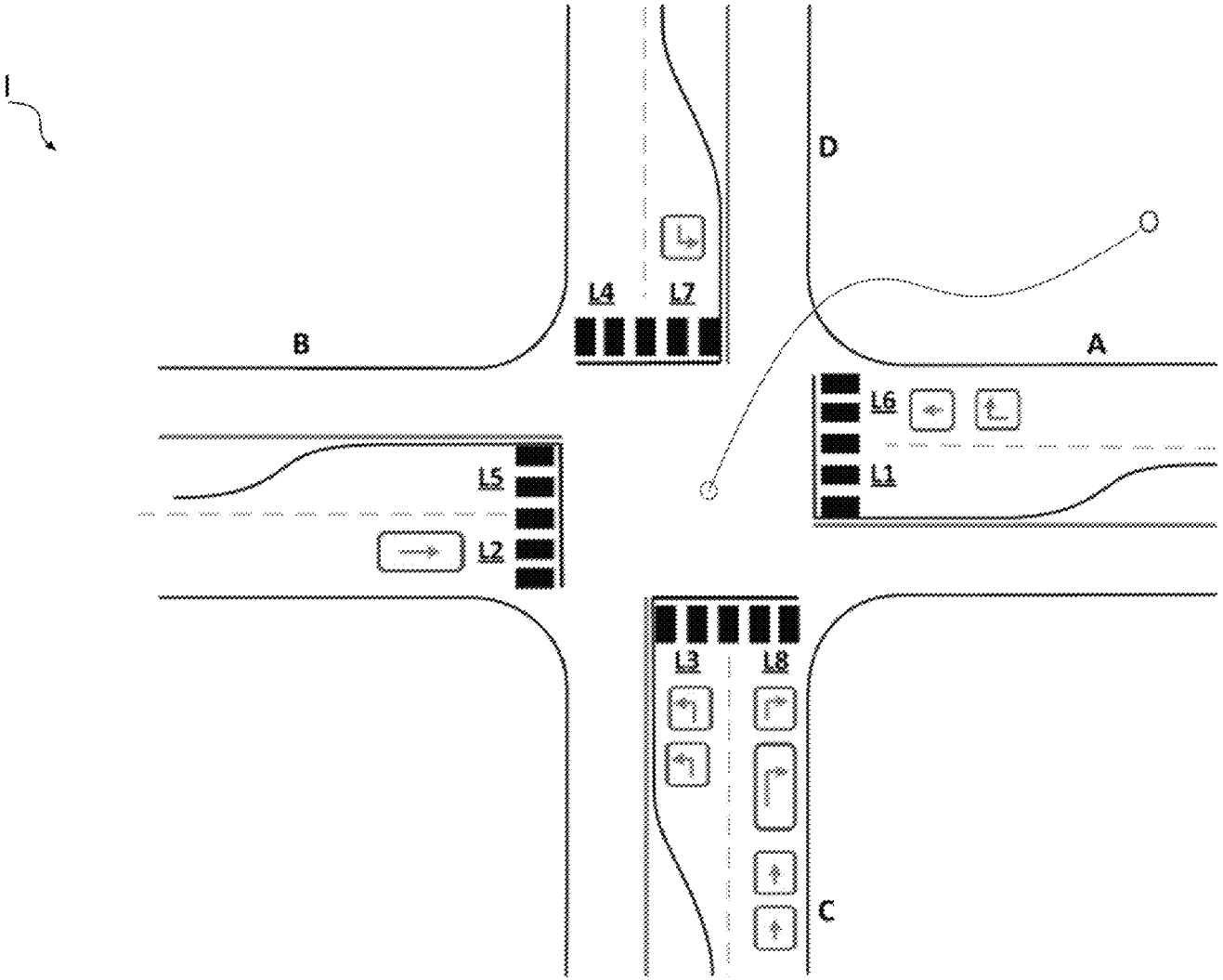
FIG. 1 shows a schematic diagram illustrating a control method of a traffic sign by utilizing a vehicular network according to one embodiment of the invention.

Please refer to FIG. 1. FIG. 1 shows a schematic diagram illustrating a control method of a traffic sign by utilizing a vehicular network according to one embodiment of the invention. In the invention, the intersection I comprises i sections and j lanes where i is a positive integer larger than 0 and j is a positive integer larger than 0. In this embodiment, the intersection I comprises four sections A~D and eight lanes L1~L8 where there are vehicles driving on the lanes L1~L8.

It is assumed that each vehicle is equipped with one on board unit (hereinafter referred to as "OBU") and the sign of each intersection I comprises one network interface and a microprocessor as a traffic sign controller. The sign can acquire the driving parameter of each vehicle through the OBU by the network interface on each vehicle and the network interface on the sign at the intersection I so that the microprocessor of the sign can dynamically change the signal of the intersection I. In one embodiment, the driving parameter further comprises an average acceleration speed value of n vehicles expected to pass the intersection where n is a positive integer larger than 0, a distance between the vehicles and a center point of the intersection, a turning message, or a response time of a driver.

When a vehicle stops due to waiting for a red light, the vehicle registers to the sign of the intersection I and transmits the driving parameter. After a registered vehicle passes one intersection, the vehicle cancels the registration from the sign of the intersection I. Thus, the sign of the intersection I collects all driving parameters of vehicles waiting at the intersection I to dynamically control the signal.

The vehicular passing rate $r_{ij}$ of the lane j in the section i at the intersection I can be calculated as follows:

$$r_{ij} = \frac{n}{t_{ij}} \tag{1}$$

where n represents the number of vehicles waiting for passing through on the lane j in the section i; $t_{ij}$ represents the expected passing time for the last registered in the section i passing through the intersection I from the lane j of the section i, that is, the expected passing time $t_{ij}$ represents the period of time for a vehicle of the $j^{th}$ lane of the $i^{th}$ section passing through the intersection I.

Figure 2A:
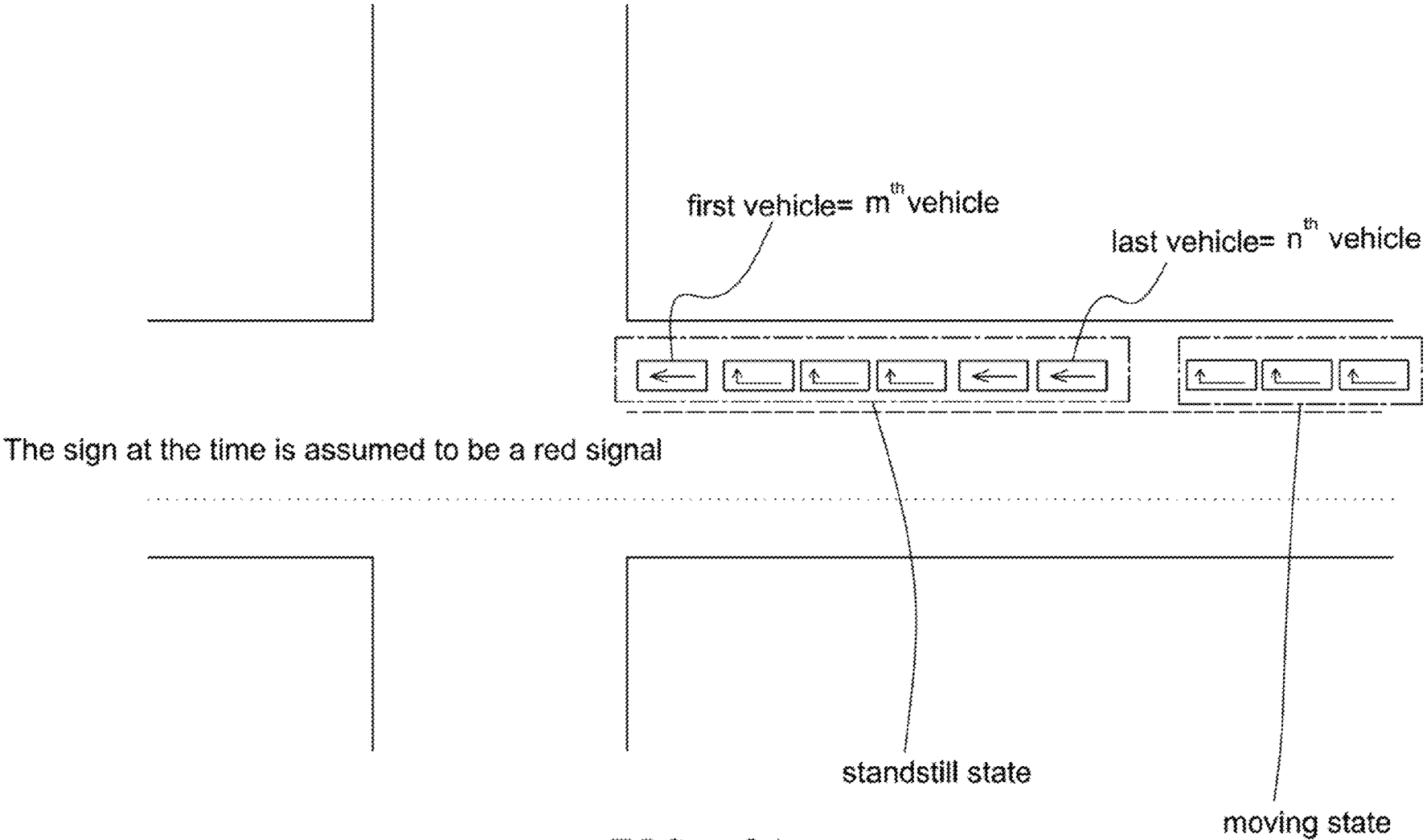
FIG. 2A shows a schematic diagram illustrating vehicles in a standstill state according to one embodiment of the invention.

Please refer to FIG. 2A. FIG. 2A shows a schematic diagram illustrating vehicles in a standstill state according to one embodiment of the invention. For clarity, only one lane is illustrated. The sign at the time is assumed to be a red signal and the $m^{th}$ vehicle and the $n^{th}$ vehicle separately represent the first vehicle and the last vehicle relatively still. Thus, m=1 and the minimum average acceleration speed of each vehicle between the $m^{th}$ vehicle and the $n^{th}$ vehicle is $a_{min}=\{a_1, a_2, \ldots, a_n\}$ that can be considered as the acceleration speed value of the $n^{th}$ vehicle. Besides, when the distance between the $n^{th}$ vehicle and the intersection I is d, the moving time t of the $n^{th}$ vehicle (the last vehicle) in the section i satisfies the following equations (2) and (3):

$$d = vt + \frac{a_{min}t^2}{2} \tag{2}$$

$$t = \frac{-v + \sqrt{v^2 + 2a_{min}d}}{a_{min}} \tag{3}$$

where v represents the speed of the $n^{th}$ vehicle. Since vehicles from the first one to the last one are all a standstill, v=0. Then, the driver's response time of the $k^{th}$ vehicle is assumed to be $\Delta t_k$, the expected passing time $t_{ij}$ can be deducted from the following equation.

$$t_{ij} = \sum_{k=m}^{n} \Delta t_k + \frac{-v + \sqrt{v^2 + 2a_{min}d}}{a_{min}} \tag{4}$$

Furthermore, the acceleration speed of the last vehicle (the $n^{th}$ vehicle) is limited by the slowest vehicle in the front and thus the acceleration speed of the slowest vehicle can be considered as the acceleration speed of the last vehicle. When a vehicle is in the moving queue, the vehicle acquires the priority at the present signal phase.

Figure 2B:
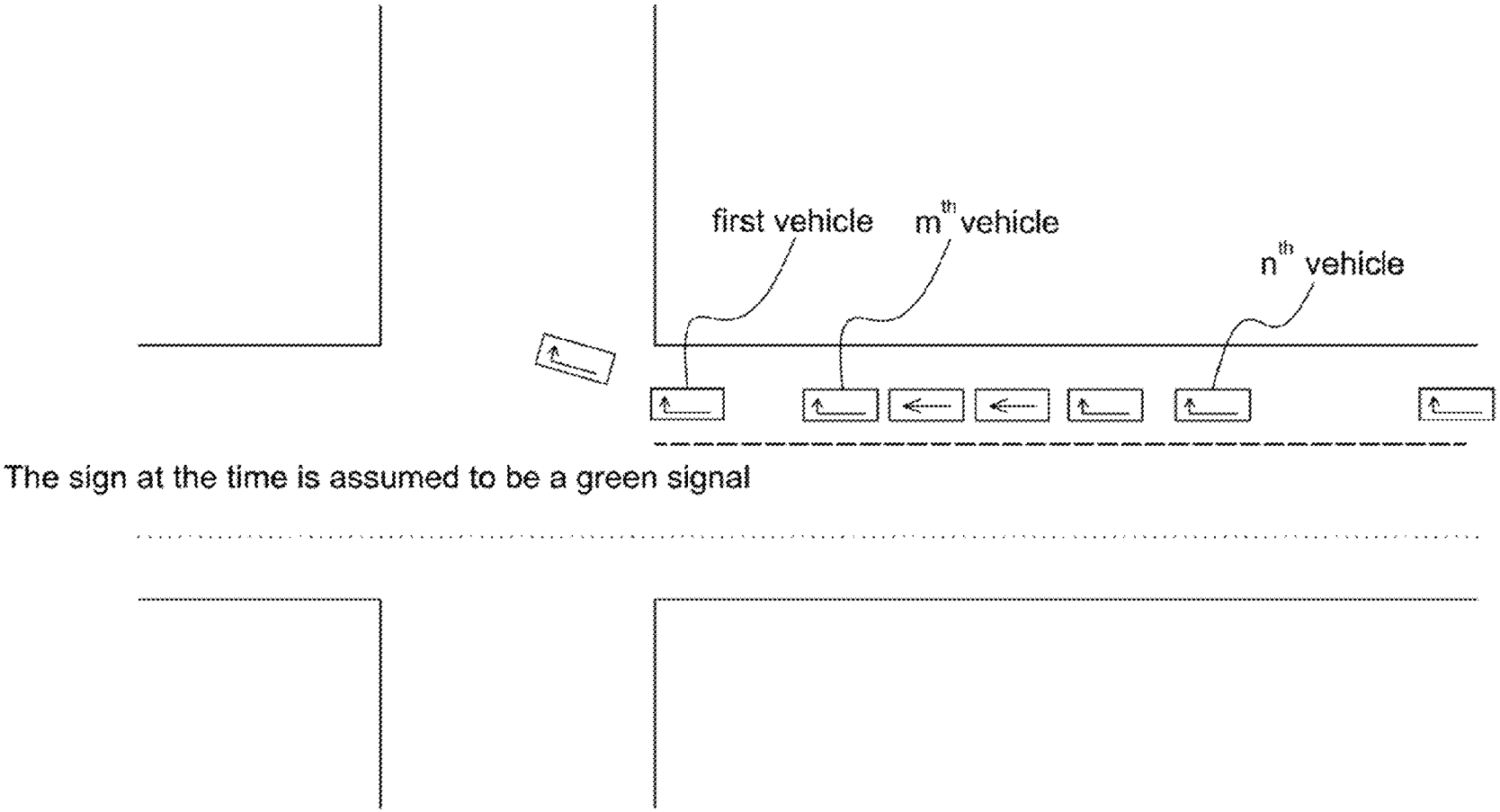
FIG. 2B shows a schematic diagram illustrating vehicles in a moving state according to one embodiment of the invention.

Please refer to FIG. 2B. FIG. 2B shows a schematic diagram illustrating vehicles in a moving state according to one embodiment of the invention. The sign at the time is assumed to be a green signal. It indicates that some vehicles are in the moving queue. Thus, m is not equal to 1 (that is, m is not the first vehicle) and the first vehicle is in the moving queue. Some vehicles do not have the driver's response time $\Delta t_k$ but the speed of the last vehicle (the $n^{th}$ vehicle) is zero and the expected passing time $t_{ij}$ is relatively short.

Figure 2C:
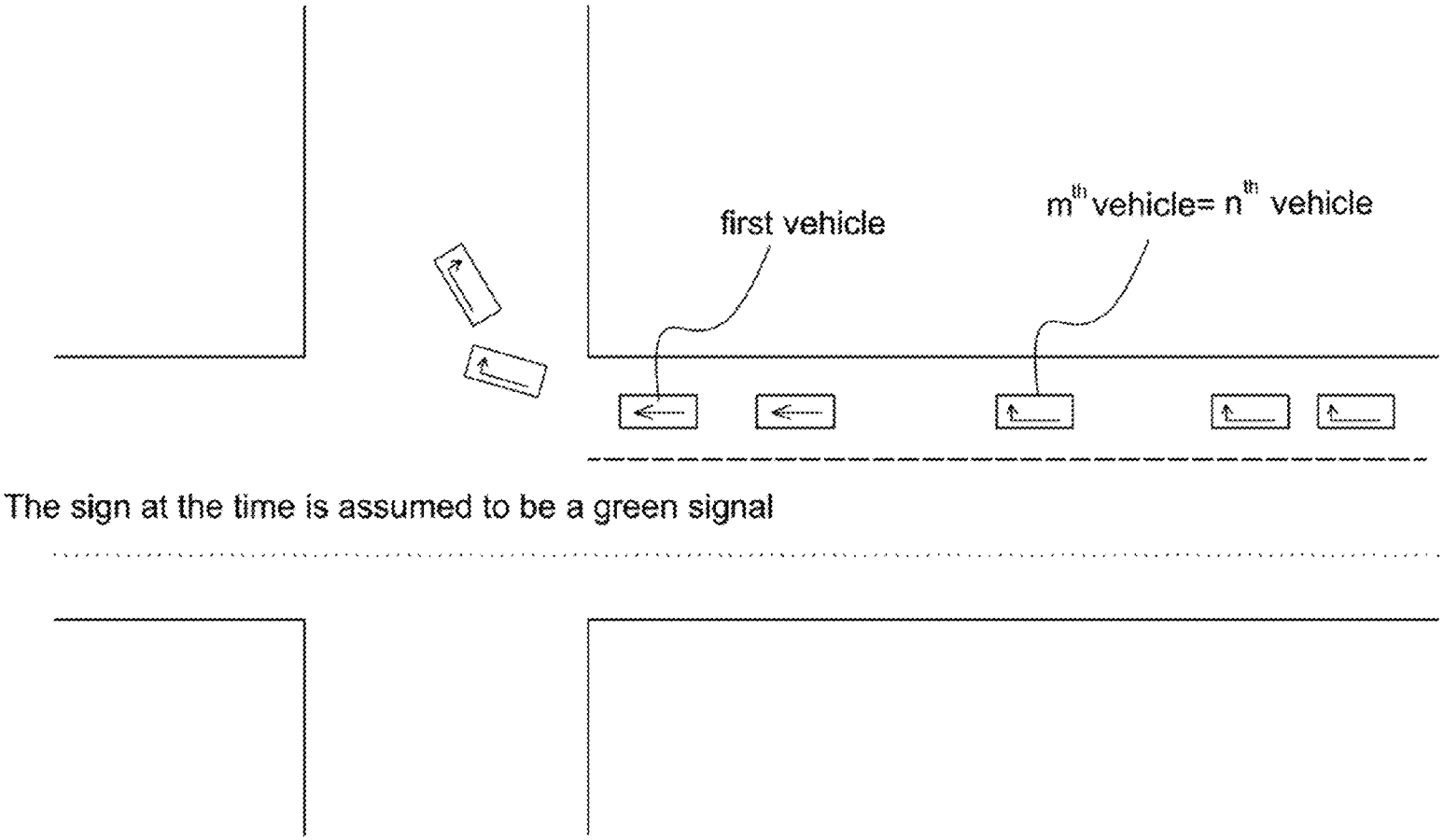
FIG. 2C shows a schematic diagram illustrating vehicles in a moving state according to one embodiment of the invention.

Please refer to FIG. 2C. FIG. 2C shows a schematic diagram illustrating vehicles in a moving state according to one embodiment of the invention. When all vehicles are in the moving queue and the sign is assumed to be a green signal, the $m^{th}$ vehicle is equal to the $n^{th}$ vehicle and the speed is not equal to zero.

Figure 3A:
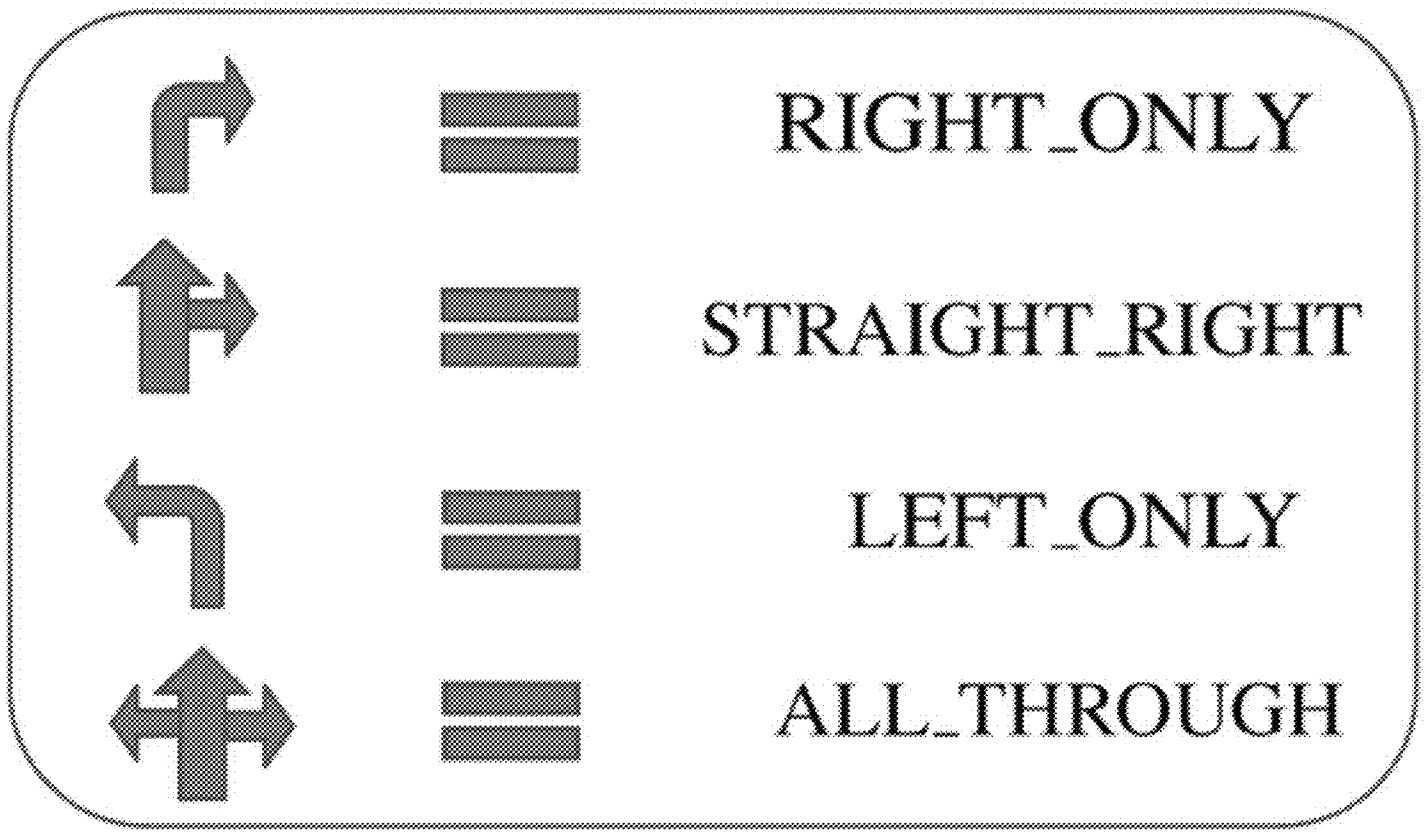
FIG. 3A shows a schematic diagram illustrating vehicular movement types according to one embodiment of the invention.

Please refer to FIG. 3A. FIG. 3A shows a schematic diagram illustrating vehicular movement types according to one embodiment of the invention. In one embodiment of the invention, there are four movement types representing a signal queue of a specific section: RIGHT_ONLY (the first movement type), STRAIGHT_RIGHT (the second movement type), LEFT_ONLY (the third movement type) and ALL_THROUGH (the fourth movement type). RIGHT_ONLY and LEFT_ONLY represent arranging a green signal for vehicles turning right and left, respectively. STRAIGHT_RIGHT represents arranging a green signal for vehicles turning right and going straight at the same time. ALL_THROUGH represents arranging a green signal for vehicles turning right and left and moving straight, that is, vehicles of the section can turn right and left and move straight.

Figure 3B:
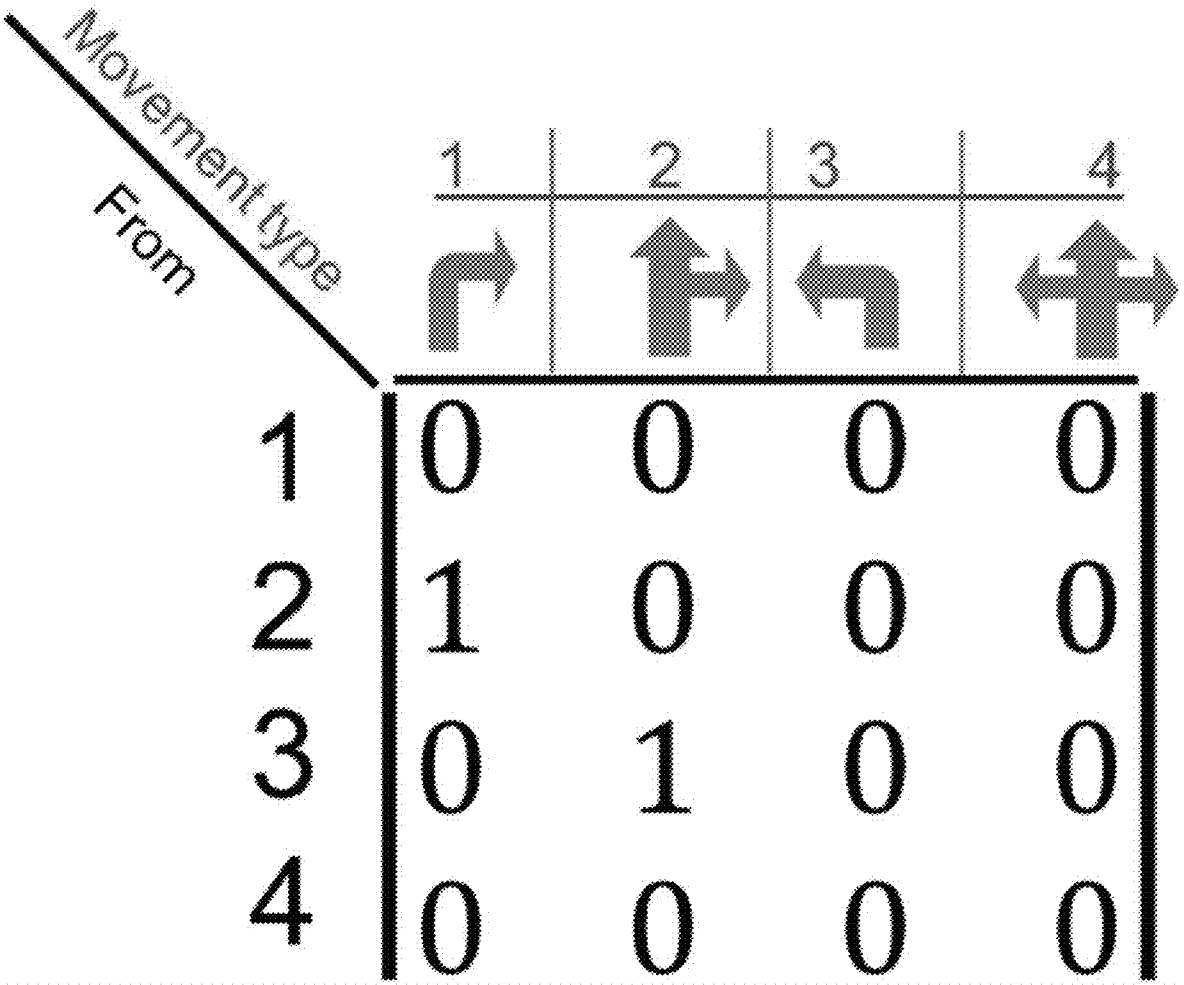
FIG. 3B shows a schematic diagram illustrating a signal phase matrix according to one embodiment of the invention.

Please refer to FIG. 3B. FIG. 3B shows a schematic diagram illustrating a signal phase matrix according to one embodiment of the invention. Each row represents moving from a section i and each column represents arranging a certain signal to set one or more types of vehicles to pass the intersection. As shown in FIG. 3B, each row represents moving from the section i and each column represents having one or more types of vehicles pass the intersection. Each unit $S^k_{ij}=1$ in the signal phase matrix means that a green signal is assigned to the condition of having the same flow attribute (hereinafter referred to as "FA") and movement type of the lane j in the section i; otherwise, $S^k_{ij}=0$. In this embodiment, the signal phase matrix $S=(S^0, S^1, \ldots, S^{15})$ is preset in the memory of the intersection controller. Please also refer to FIG. 3C as well. In this embodiment, a total of 16 $S^0$, $S^1, \ldots, S^{15}$ are designed and the intersection controller selects one signal phase matrix from the signal phase matrix group $S=(S^0, S^1, \ldots, S^{15})$ to represent the signal phase. The selected signal phase matrix represents setting of next green light of the intersection.

When a vehicle stops at the intersection I, the vehicle registers to the intersection controller and the driving parameter of each vehicle is transmitted. Thus, the intersection controller of the intersection I receives the turning direction or the position on the lane of each vehicle. According to the driving parameter registered by each vehicle, the intersection controller schedules next green signal and its holding time and the schedule will complete before the present green signal becomes invalid. Through scheduling, the intersection controller firstly sets FA of each lane according to the registered data of vehicles of the lane j. In this embodiment, FA is set from the leftmost lane to the rightmost lane and each lane can have more than one FA. The setting is based on the following rule.

1. If no vehicle is to go straight on the left turn lane, LEFT_ONLY is set to the left turn lane and STRAIGHT_RIGHT is set to all other lanes.
2. If only vehicles are to go straight on the left turn lane, STRAIGHT_RIGHT is set to all lanes.
3. If vehicles are to go straight and to turn left both on the left turn lane at the same time, ALL_THROUGH is set to all lanes.
4. If no vehicle is to go straight on the right turn lane, RIGHT_ONLY is set to the right turn lane.

When the intersection controller sets FA for all of the lanes, the intersection controller generates a passing rate matrix $R_{n\times m}$ where n is the number of sections at the intersection and m number of movement types. Each item $R_{ij}$ of $R_{n\times m}$ can be calculated by the following equation (5).

$$R_{ij} = \sum_{k=1}^{l} r^k_{ij} \tag{5}$$

where l is the number of lanes in the section i and $r^k_{ij}$ is the passing rate of the $k^{th}$ lane having the same FA and moving behavior in the section i. Then, the weight $W^k$ of each signal phase matrix $S^k$ is calculated as follows.

$$W^k = \sum_{i=1}^{n} \sum_{j=1}^{m} R_{ij} \times S^k_{ij} \tag{6}$$

In the above, $S^k$ is the $k^{th}$ signal phase matrix in the signal phase matrix group $S=(S^0, S^1, \ldots, S^{15})$ and there are 16 signal phase matrixes in the matrix group. The intersection controller selects the signal phase matrix $S_{max}$ having the maximum weight in order to have the number of vehicles passing through the intersection at the next green signal be maximum. On the other hand, after $S_{max}$ is selected, the shortest passing time in $S_{max}$ is the time $T_{green}$ of the next green signal to make the passing rate be maximum.

It should be noted that the invention can use the shortest green signal time $T_{min}$ and the maximum green signal time $T_{max}$ to prevent having the green signal time $T_{green}$ be too long or too short. The extension time of $S_{max}$ can prevent the same $S_{max}$ from being frequently interrupted.

Figure 4A:
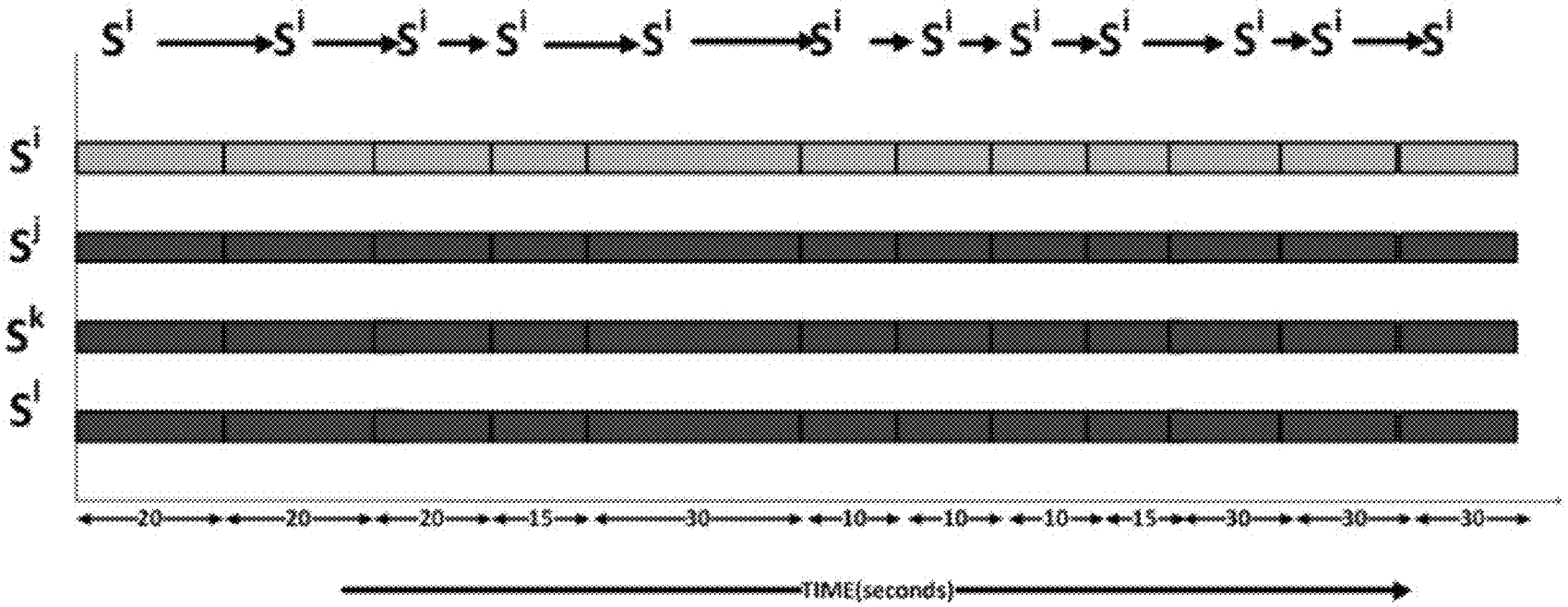
FIG. 4A shows a schematic diagram illustrating phases $S^i$, $S^j$, $S^k$, and $S^l$ according to one embodiment of the invention.

Please refer to FIG. 4A. FIG. 4A shows a schematic diagram illustrating phases $S^i$, $S^j$, $S^k$, and $S^l$ according to one embodiment of the invention. The light colored block represents the green signal time and the dark colored block represents the red signal time. In this embodiment, the signal phase matrix $S^i$ possesses the higher passing rate and thus always receives priority for passing the intersection. In order to prevent such a signal phase matrix having higher passing rate from always acquiring the priority, a preset time $t_{ij}^{age}$ is designed and the matrix $A_{n\times m}$ is generated. Regarding the signal phase matrix having the lower passing rate, the preset time $t_{ij}^{age}$ is the waiting time for vehicles on the lane j in section i.

Besides, when the fourth movement type (ALL_THROUGH) obtains passing right, all other movement type are all considered to possess passing right. Similarly, if the second movement type (STRAIGHT_RIGHT) obtains passing right, the first movement type (RIGHT_ONLY) also obtains passing right.

When the preset time $t_{ij}^{age}$ of the first~fourth movement types is larger than or equal to a predefined threshold time $T_{age}$, the priority of the movement type is increased as shown in the following equation (7).

$$A_{ij} = \begin{cases} 100 & \text{if } t_{ij}^{age} \geq T_{age} \text{(High priority)} \\ 1 & \text{if } t_{ij}^{age} < T_{age} \text{(Normal priority)} \end{cases} \tag{7}$$

By the A matrix, the weight of each signal phase matrix Sk can be calculated by the following equation (8).

$$W^k = \sum_{i=1}^{n}\sum_{j=1}^{m} R_{ij} \times S_{ij}^k \times A_{ij} \tag{8}$$

Figure 4B:
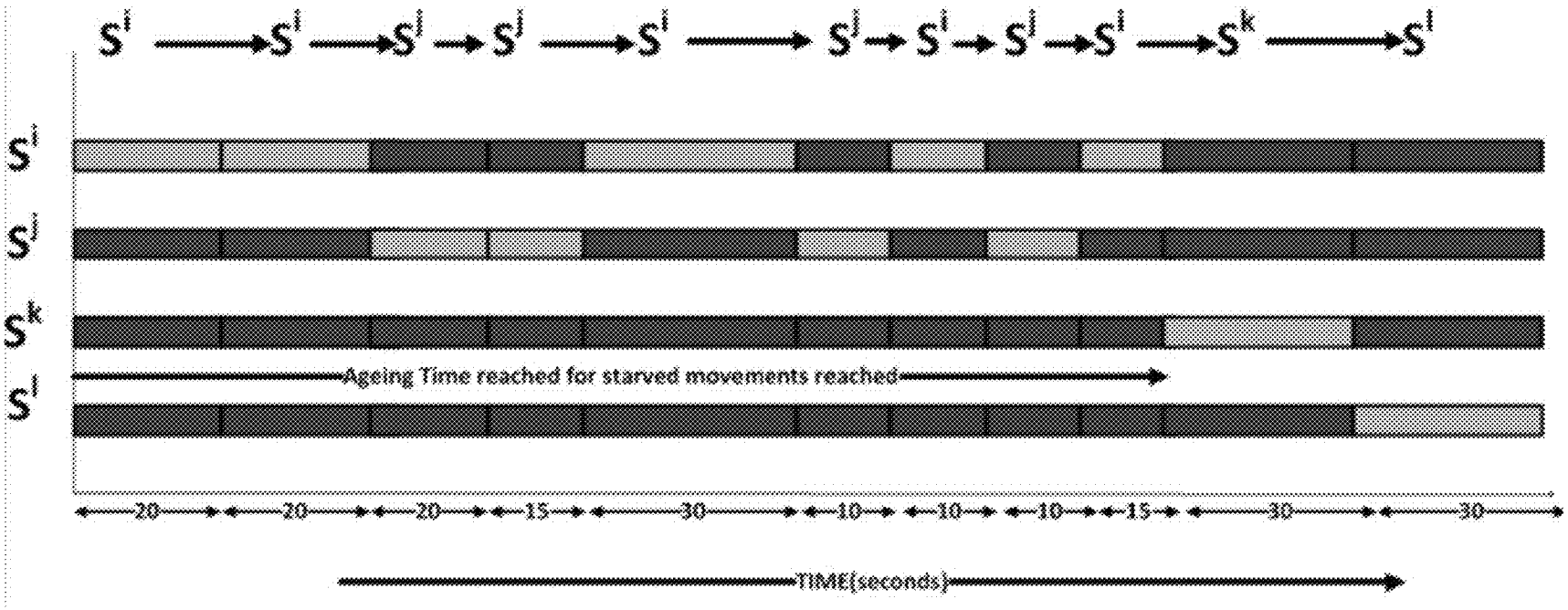
FIG. 4B shows a schematic diagram illustrating phases $S^i$, $S^j$, $S^k$, and $S^l$ according to one embodiment of the invention.

Please refer to FIG. 4B. FIG. 4B shows a schematic diagram illustrating phases $S^i$, $S^j$, $S^k$, and $S^l$ according to one embodiment of the invention. FIG. 4B shows even though there is $A_{ij}$ matrix, the signal phase matrixes $S^i$ and $S^j$ can alternately obtain passing right until the priority of the signal phase matrixes $S^i$ and $S^j$ is increased. In order to prevent some signal phase matrix having the higher passing rate in the section from uninterruptedly obtaining passing right, the invention uses a phase-served matrix $P_{n\times m}$ to make the used signal phase matrix not repeatedly obtain passing right until all other movement types at the intersection are used.

In this embodiment, the movement type of the used signal phase matrix is masked and thus the passing rate is not considered while the weight of the signal phase matrix is calculated but arrangement of the green signal extension is allowed for some specific phases. Masking the movement type of the used signal phase matrix only occurs when the green signal is arranged to the unused signal phase. When the unused signal phase matrix obtains priority, the phase-served matrix will mask the used signal phase matrix as follows.

$$P_{ij} = \begin{cases} 0 & \text{if the movement belongs to the served phase} \\ 1 & \text{default value} \end{cases} \tag{9}$$

Through the phase-served matrix, the weight of each signal phase matrix $S^k$ can be calculated by the following equation (10).

$$W^k = \sum_{i=1}^{n}\sum_{j=1}^{m} R_{ij} \times S_{ij}^k \times A_{ij} \times P_{ij} \tag{10}$$

Figure 4C:
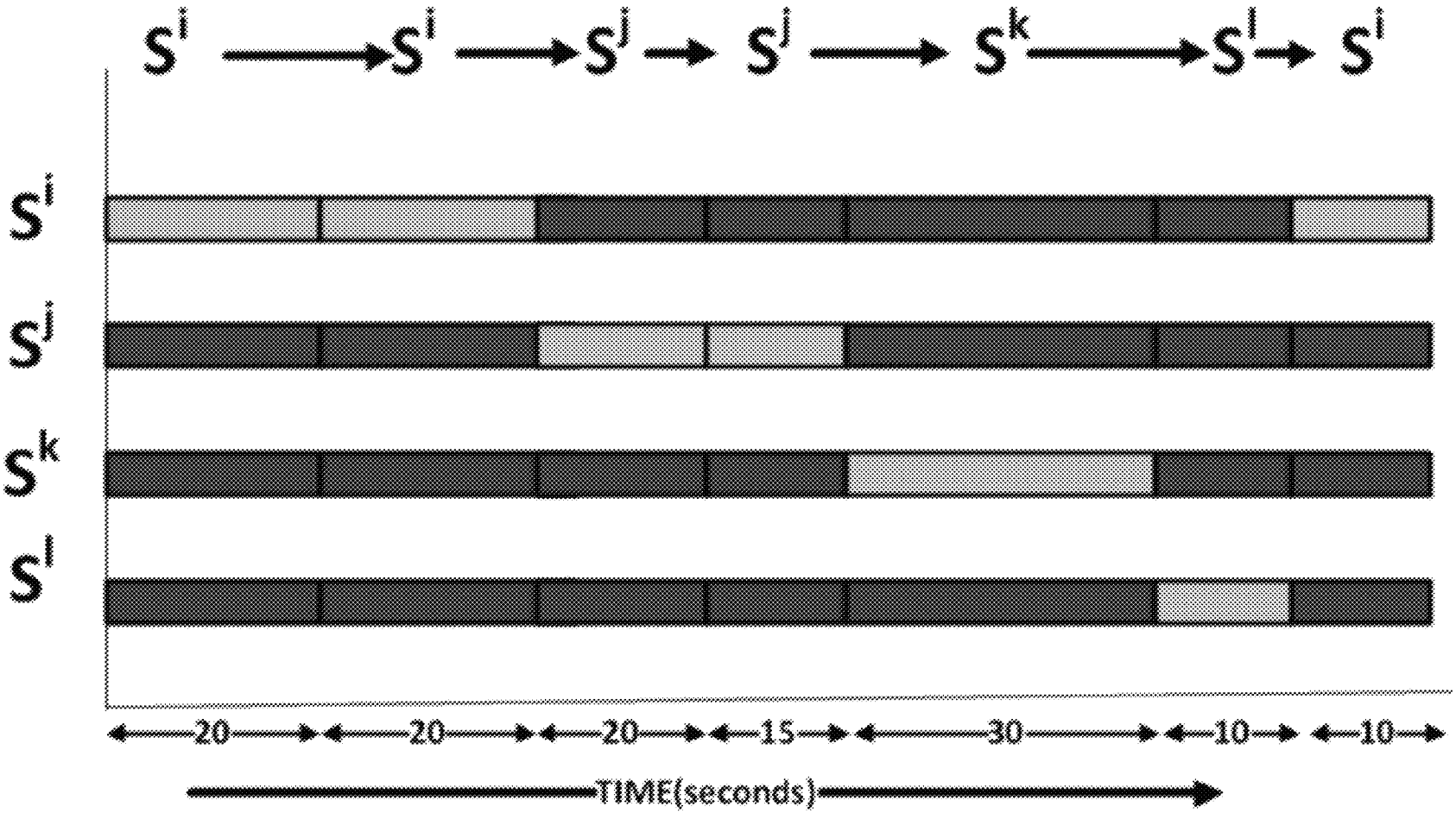
FIG. 4C shows a schematic diagram illustrating phases $S^i$, $S^j$, $S^k$, and $S^l$ according to one embodiment of the invention.

If each item of the matrix P is masked to be zero, the values of all items are reset to 1. Please simultaneously refer to FIG. 4C. As shown in FIG. 4C, through the phase-served matrix, the problem of the signal phase matrix having the higher passing rate repeatedly obtaining priority is solved.

Figure 5:
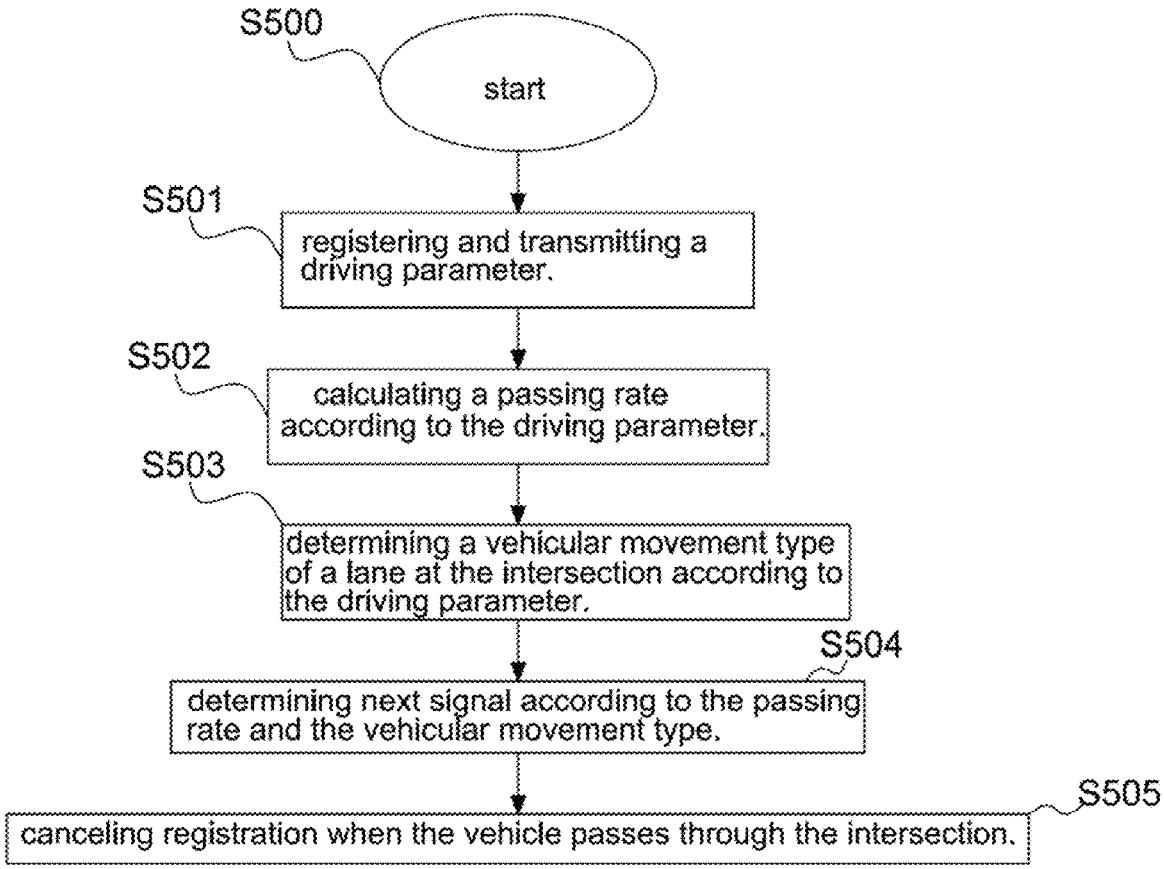
FIG. 5 shows a flow chart illustrating a control method of a traffic sign by utilizing a vehicular network according to one embodiment of the invention.

Please simultaneously refer to FIG. 5. FIG. 5 shows a flow chart illustrating a control method of a traffic sign by utilizing a vehicular network according to one embodiment of the invention. The method comprises the following steps:

Step S500: start;

Step S501: registering and transmitting a driving parameter;

Step S502: calculating a passing rate according to the driving parameter;

Step S503: determining a vehicular movement type of a lane at the intersection according to the driving parameter;

Step S504: determining next signal according to the passing rate and the vehicular movement type;

Step S505: canceling registration when the vehicle passes through the intersection.

In conclusion, the invention uses the driving parameter of each vehicle to adjust the schedule of the signal at the intersection to have the vehicular passing rate of each intersection schedule of the signal at the intersection be maximized and to fairly arrange the schedule of the signal at the intersection. Although the present invention has been fully described by the above embodiments, the embodiments should not constitute the limitation of the scope of the invention. Various modifications or changes can be made by those who are skilled in the art without deviating from the spirit of the invention. Any embodiment or claim of the present invention does not need to reach all the disclosed objects, advantages, and uniqueness of the invention. Besides, the abstract and the title are only used for assisting the search of the patent documentation and should not be construed as any limitation on the implementation range of the invention.

What is claimed is:

1. A control method of a traffic sign by utilizing a vehicular network, applicable to an intersection, the method comprising:

a passing rate calculating step, calculating a passing rate according to a driving parameter;

a vehicular movement type determining step, determining a vehicular movement type of a lane at the intersection according to the driving parameter; and a signal determining step, determining next signal according to the passing rate and the vehicular movement type;

wherein, the driving parameter further comprises an average acceleration speed value of n vehicles expected to pass the intersection where n is a positive integer larger than 0, a distance between the vehicles and a center point of the intersection, a turning message, or a response time where the turning message is a message regarding the vehicles passing the intersection non-straight and the response time means average time from a standstill to moving for the vehicles; the intersection has i sections and j lanes where i is a positive integer larger than 0 and j is a positive integer larger than 0; an expected passing time $t_{ij}$ is time for a vehicle of the $j^{th}$ lane in the $i^{th}$ section passing through the intersection; and a passing rate $r_{ij}$ is a ratio of the number of vehicles of the $j^{th}$ lane in the $i^{th}$ section passing within the expected passing time $t_{ij}$ to the expected passing time $t_{ij}$; and the passing rate calculating step further comprises:

acquiring a minimum accelerate speed value $a_{min}$ according to the average acceleration speed value of the n vehicles;

calculating a moving time t of the n vehicles according to where the last one of the n vehicles is positioned, where the center point is positioned and the minimum accelerate speed value $a_{min}$; and calculating the expected passing time $t_{ij}$ according to the moving time and the response time of the n vehicles, if the n vehicles are a standstill; calculating the expected passing time $t_{ij}$ according to the moving time t, if the n vehicles are not a standstill.

2. The method according to claim 1, wherein the vehicular movement type determining step comprises:

determining a movement type of vehicles of each section according to the turning message of the vehicles of each lane.

3. The method according to claim 2, wherein the movement type comprises:

a first movement type that vehicles in the section are all turning right;

a second movement type that vehicles in the section are going straight or turning right;

a third movement type that vehicles in the section are all turning left; and a fourth movement type that vehicles in the section are turning right or left, or going straight.

4. The method according to claim 3, wherein the signal determining step comprises:

determining next signal according to the movement type of each section and the passing rate $r_{ij}$ where the signal lets the number of vehicles passing the intersection be maximum.

5. The method according to claim 4, further comprising:

a fairness adjustment step, to maintain each lane having vehicles passing through according to an operating time of the signal of the intersection.

6. The method according to claim 5, wherein, when the operating time is larger than a first preset value, the operating time is adjusted.

7. The method according to claim 6, wherein, when the operating time is larger than a second preset value, the operating time is adjusted.

* * * * *